US011293288B2

(12) United States Patent
Akturk et al.

(10) Patent No.: US 11,293,288 B2
(45) Date of Patent: Apr. 5, 2022

(54) TURBINE BLADE WITH TIP TRENCH

(71) Applicant: Siemens Energy Global GmbH & Co. KG, Munich (DE)

(72) Inventors: Ali Akturk, Oviedo, FL (US); Andrew Miller, Ft. Worth, TX (US); Krishan Mohan, Orlando, FL (US); David Monk, St. Cloud, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 33 days.

(21) Appl. No.: 16/755,326

(22) PCT Filed: Oct. 31, 2017

(86) PCT No.: PCT/US2017/059211
§ 371 (c)(1),
(2) Date: Apr. 10, 2020

(87) PCT Pub. No.: WO2019/088992
PCT Pub. Date: May 9, 2019

(65) Prior Publication Data

US 2021/0199015 A1 Jul. 1, 2021

(51) Int. Cl.
*F01D 5/20* (2006.01)

(52) U.S. Cl.
CPC ..... *F01D 5/20* (2013.01); *F05D 2220/32* (2013.01); *F05D 2240/30* (2013.01); *F05D 2240/307* (2013.01); *F05D 2240/55* (2013.01)

(58) Field of Classification Search
CPC ..... F01D 5/20; F05D 2240/307
See application file for complete search history.

(56) References Cited

U.S. PATENT DOCUMENTS 5,503,527 A 4/1996 Lee et al.
5,733,102 A 3/1998 Lee et al.
5,997,251 A 12/1999 Lee
6,059,530 A * 5/2000 Lee ..... F01D 5/145 416/96 A (Continued)

FOREIGN PATENT DOCUMENTS

EP 3232004 A1 10/2017
GB 791751 A 3/1958

(Continued)

OTHER PUBLICATIONS

PCT International Search Report and Written Opinion of International Searching Authority dated Aug. 7, 2018 corresponding to PCT International Application No. PCT/US2017/059211 filed Oct. 31, 2017.

*Primary Examiner* — Eldon T Brockman

(57) ABSTRACT

A turbine blade includes a tip cap disposed over an outer wall of a blade airfoil. A trench is defined on a radially outer side of the tip cap facing a hot gas path fluid. The trench is formed by a trench floor flanked on laterally opposite sides by first and second trench side faces such that the trench floor is located radially inwardly in relation to a radially outer surface of the tip cap. The trench extends from a trench inlet located at or proximal to an airfoil leading edge to a trench outlet located at or proximal to an airfoil trailing edge. The trench is configured to entrain a tip leakage flow from the trench inlet to the trench outlet.

15 Claims, 5 Drawing Sheets

(56) References Cited

U.S. PATENT DOCUMENTS

| | | | | |
|---|---|---|---|---|
| 6,086,328 | A | 7/2000 | Lee | |
| 8,444,389 | B1 * | 5/2013 | Jones | F01D 5/14 416/193 A |
| 8,708,645 | B1 * | 4/2014 | Liang | F01D 5/20 415/173.1 |
| 8,801,377 | B1 * | 8/2014 | Liang | F01D 5/186 416/97 R |
| 9,255,481 | B2 * | 2/2016 | Lim | F01D 5/145 |
| 9,260,972 | B2 * | 2/2016 | Zelesky | F01D 5/18 |
| 10,267,330 | B2 * | 4/2019 | Krishnababu | F04D 29/388 |
| 2005/0232771 | A1 * | 10/2005 | Harvey | F01D 5/20 416/97 R |
| 2011/0255985 | A1 | 10/2011 | Diamond et al. | |

FOREIGN PATENT DOCUMENTS

| | | | |
|---|---|---|---|
| JP | 2000297603 | A | 10/2000 |
| JP | 2014227957 | A | 12/2014 |
| JP | 2017180260 | A | 10/2017 |
| WO | 2015130254 | A2 | 9/2015 |

* cited by examiner

View II-II

View IV-IV

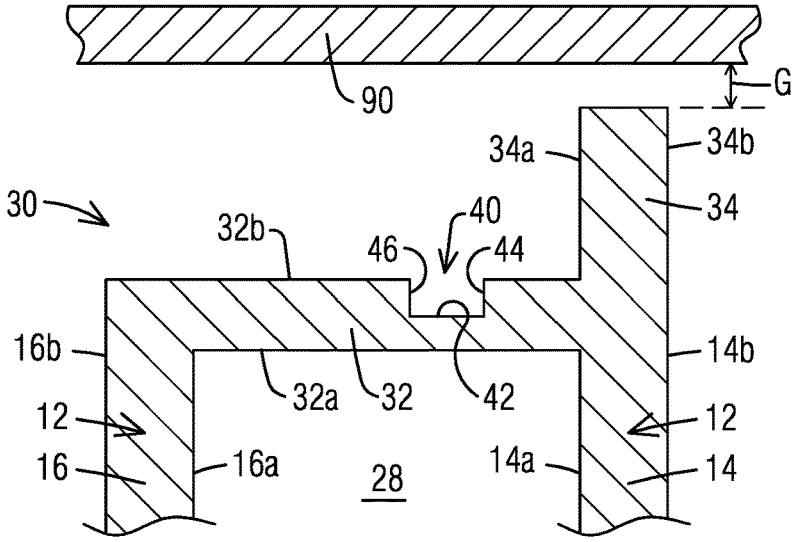
FIG. 8
FIG. 9
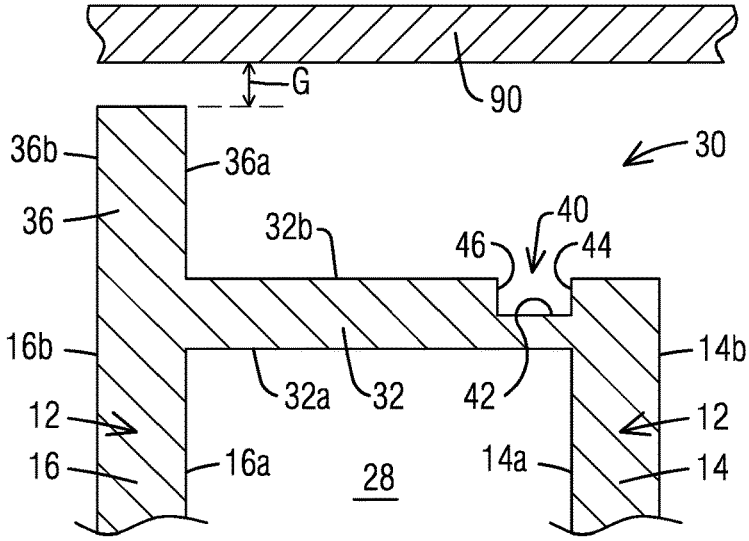
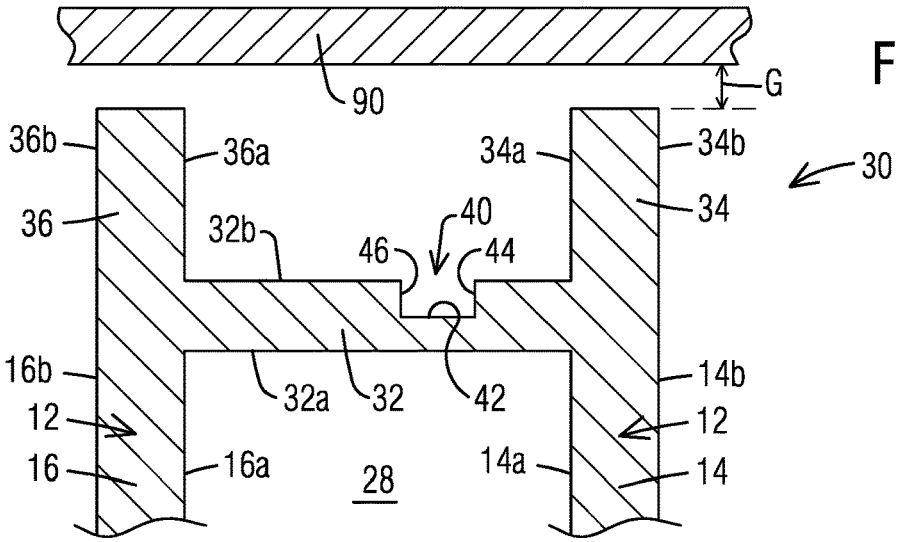
FIG. 10

TURBINE BLADE WITH TIP TRENCH

BACKGROUND

1. Field

The present invention relates to turbine blades for gas turbine engines, and in particular to turbine blade tips.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power.

Typically, a turbine blade is formed from a root at one end, and an elongated portion forming an airfoil that extends outwardly from a platform coupled to the root. The airfoil comprises a tip at a radially outward end, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. The tip features are often referred to as squealer tips and are frequently incorporated onto the tips of blades to help reduce pressure losses between turbine stages. These features are designed to minimize the leakage between the blade tip and the ring segment.

SUMMARY

Briefly, aspects of the present invention provide a turbine blade with an improved blade tip design for reducing leakage flow.

According an aspect of the invention, a turbine blade is provided. The blade comprises an airfoil comprising an outer wall formed by a pressure side and a suction side joined at a leading edge and at a trailing edge. The blade has a blade tip at a first radial end and a blade root at a second radial end opposite the first radial end for supporting the blade and for coupling the blade to a disc. The blade tip comprises a tip cap disposed over the outer wall of the airfoil. A trench is defined on a radially outer side of the tip cap facing a hot gas path fluid. The trench is formed by a trench floor flanked on laterally opposite sides by first and second trench side faces such that the trench floor is located radially inwardly in relation to a radially outer surface of the tip cap. The trench extends from a trench inlet located at or proximal to the leading edge to a trench outlet located at or proximal to the trailing edge. The trench is configured to entrain a tip leakage flow from the trench inlet to the trench outlet.

BRIEF DESCRIPTION OF THE DRAWINGS

The invention is shown in more detail by help of figures. The figures show specific configurations and do not limit the scope of the invention.

FIGS. 8, 9 and 10 are cross-sectional views illustrating various further embodiments of the invention including a combination of tip trench and one or more squealer tip walls.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the context of this specification, the term "chord-length" refers to a distance along an airfoil camber line from the leading edge to the trailing edge. The camber line refers to an imaginary line extending centrally between the pressure side and the suction side from the leading edge to the trailing edge of the airfoil. When a location is expressed as a percentage of chord-length, it refers to the distance along the camber line from the leading edge to a point at which a perpendicular drawn from said location intersects the camber line, as a percentage of the chord-length.

Figure 1:
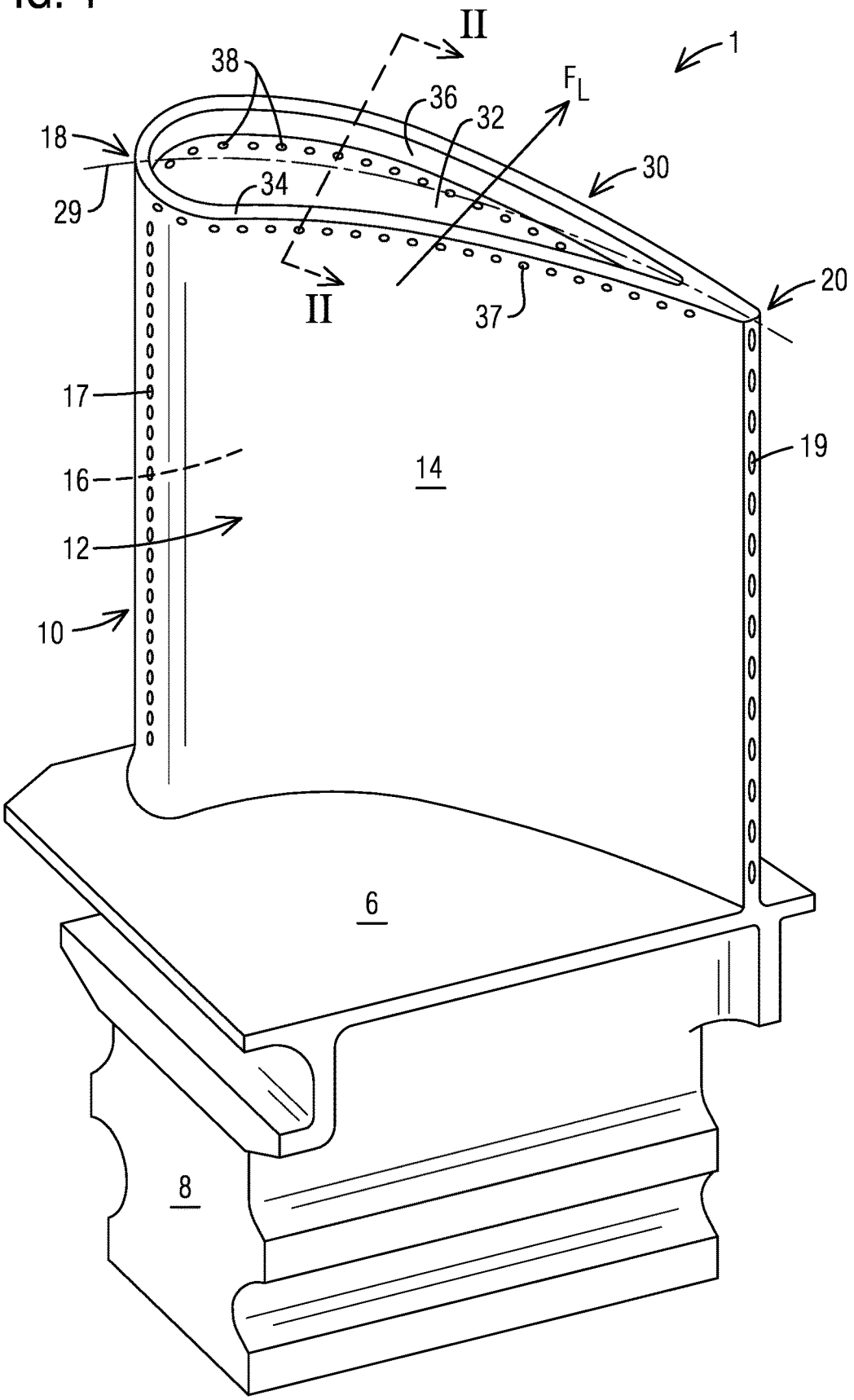
FIG. 1 is a perspective view of a known type of turbine blade.

Referring to the drawings wherein identical reference characters denote the same elements, FIG. 1 illustrates a turbine blade 1. The blade 1 includes a generally hollow airfoil 10 that extends radially outwardly from a blade platform 6 and into a stream of a hot gas path fluid. A root 8 extends radially inward from the platform 6 and may comprise, for example, a conventional fir-tree shape for coupling the blade 1 to a rotor disc (not shown). The airfoil 10 comprises an outer wall 12 which is formed of a generally concave pressure side 14 and a generally convex suction side 16 joined together at a leading edge 18 and at a trailing edge 20 defining a camber line 29. The airfoil 10 extends from the root 8 at a radially inner end to a tip 30 at a radially outer end, and may take any configuration suitable for extracting energy from the hot gas stream and causing rotation of the rotor disc.

Figure 2:
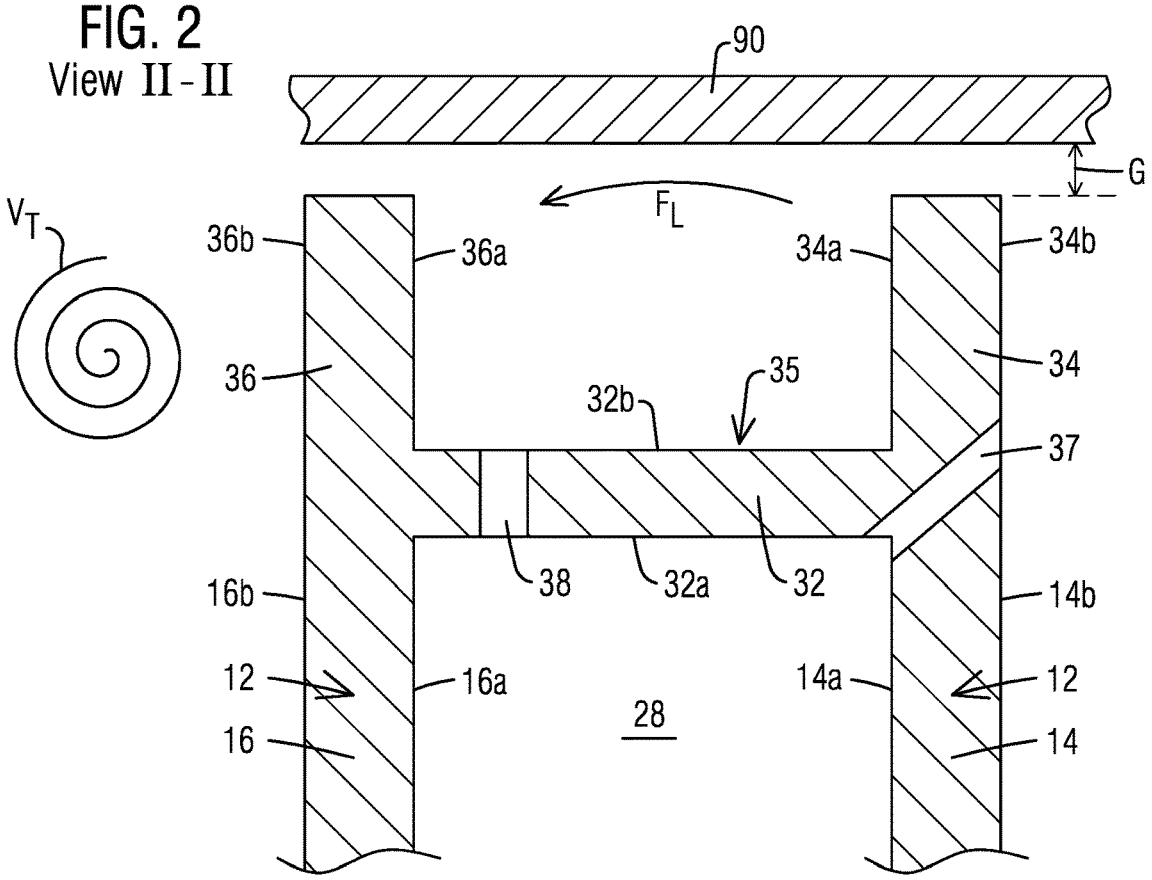
FIG. 2 is a cross-sectional view along the section II-II in FIG. 1.

As shown in FIG. 2, the interior of the hollow airfoil 10 may comprise at least one internal cavity 28 defined between an inner surface 14*a* of the pressure side 14 and an inner surface 16*a* of the suction side 16, to form an internal cooling system for the turbine blade 1. The internal cooling system may receive a coolant, such as air diverted from a compressor section (not shown), which may enter the internal cavity 28 via coolant supply passages typically provided in the blade root 8. Within the internal cavity 28, the coolant may flow in a generally radial direction, absorbing heat from the inner surfaces 14*a*, 16*a* of the pressure and suction sides 14, 16, before being discharged via external orifices 17, 19, 37, 38 into the hot gas path.

Particularly in high pressure turbine stages, the blade tip 30 may be conventionally formed as a so-called "squealer tip". Referring jointly to FIG. 1-2, the blade tip 30 may be formed of a tip cap 32 disposed over the outer wall 12 at the radially outer end of the outer wall 12. The tip cap 32 comprises a radially inner surface 32*a* facing the internal cavity 28 and a radially outer surface 32*b* exposed to the hot gas path fluid. The blade tip 30 further comprises a pair of squealer tip walls, namely a pressure side squealer tip wall 34 and a suction side squealer tip wall 36, each extending radially outward from the tip cap 32. The pressure and suction side squealer tip walls 34 and 36 may extend substantially or entirely along the perimeter of the tip cap 32 to define a tip cavity 35 between an inner surface 34*a* of the pressure side squealer tip wall 34 and an inner surface 36*a* of the suction side squealer tip wall 36. An outer surface 34*b* of the pressure side squealer tip wall 34 may be contiguous with an outer surface 14*b* of the pressure side 14, while an outer surface 36*b* of the suction side squealer tip wall 36 may be contiguous with an outer surface 16*b* of the suction side 16. The blade tip 30 may additionally include a plurality of cooling holes 37, 38 that fluidically connect the internal cavity 28 with an external surface of the blade tip 30 exposed to the hot gas path fluid. In the shown example, the cooling holes 37 are formed through the pressure side squealer tip wall 34 while the cooling holes 38 are formed through the tip cap 32 opening into the tip cavity 35. Additionally, or alternately, cooling holes may be provided at other locations at the blade tip 30.

The squealer tip walls 34, 36 are typically designed as sacrificial features in a turbine blade to maintain a small radial tip clearance G between the radially outermost point of the blade tip and a stationary turbine component, such as a ring segment 90 (see FIG. 2), for better turbine efficiency and to protect the airfoil internal cooling system under the tip cap 32 in the event of the tip 30 rubbing against the ring segment 90 during transient engine operation. In operation, pressure differences between the pressure side and the suction side of the turbine blade 1 may drive a leakage flow $F_L$ from the pressure side to the suction side through the clearance between the rotating blade tip 30 and the surrounding stationary turbine component (not shown). The leakage flow $F_L$ may lead to a reduction in efficiency of the turbine rotor. There may be two primary causes of such an efficiency loss: first, the tip leakage flow $F_L$ exerts no work on the blade, thus reducing the power generated; second, the tip leakage flow $F_L$ may mix with the main flow $F_M$ of the gas path fluid (which is generally along an axial direction) as it exits the clearance gap, rolling up into a vortical structure $V_T$ (see FIG. 2). The vortical structure $V_T$, referred to as tip leakage vortex, results in a pressure loss and a further reduction in rotor efficiency. Configuring the blade tip as a squealer with one or more squealer tip walls 34, 36 may mitigate some of the issues related to tip leakage flow. Embodiments of the present invention are aimed at further improving tip leakage losses by providing a novel blade tip geometry incorporating trench at the blade tip.

Figure 3:
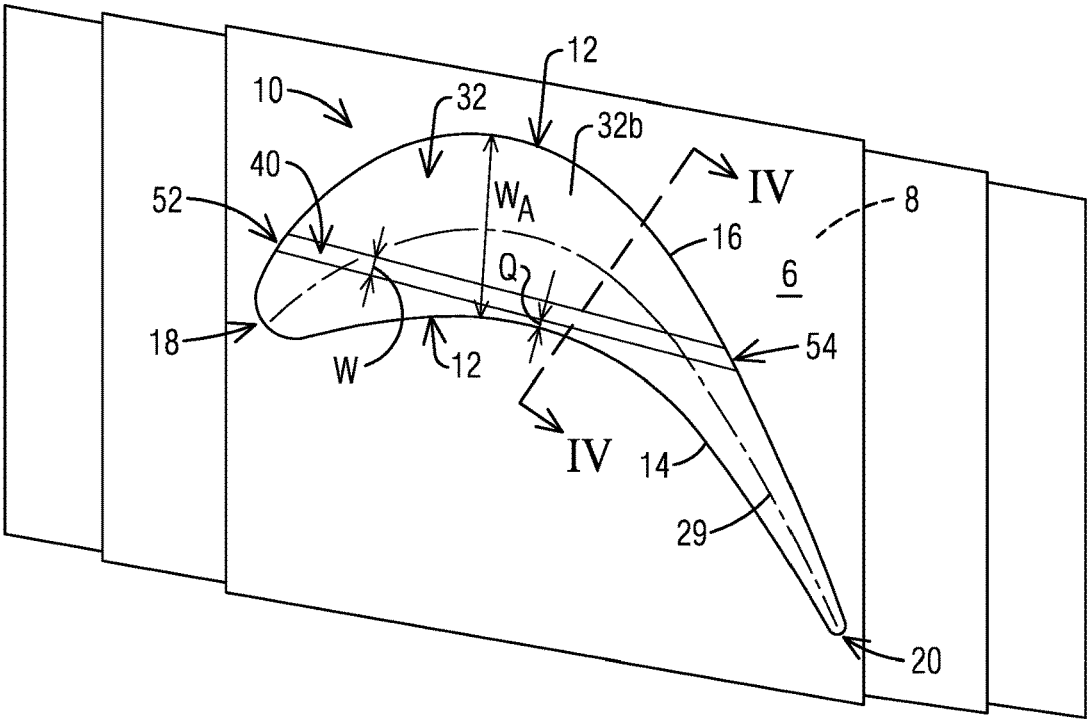
FIG. 3 is a radial top view of a turbine blade with a tip trench in accordance with one embodiment of the invention.
Figure 4:
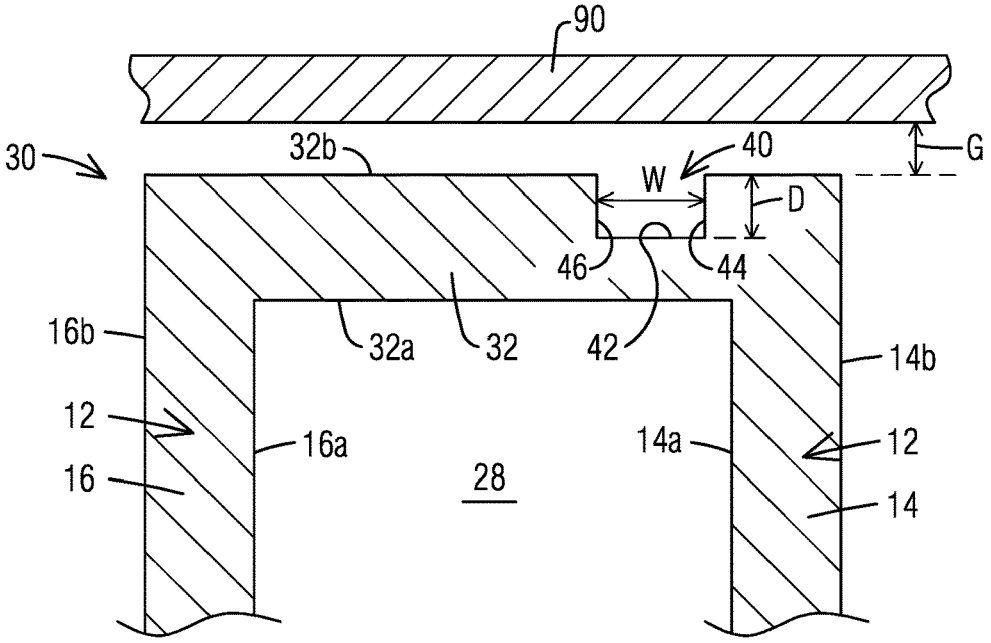
FIG. 4 is a cross-sectional view along the section IV-IV in FIG. 3.

A first example embodiment of the present invention is depicted in FIGS. 3 and 4, wherein like reference numerals are retained for like elements. Similar to the configuration shown in FIG. 1-2, the turbine blade 1 illustrated in FIG. 3-4 comprises an airfoil 10 comprising an outer wall 12, which is formed by a generally concave pressure side 14 and a generally convex suction side 16 joined at a leading edge 18 and at a trailing edge 20. A blade tip 30 is located at a first radial end and a blade root 8 is located at a second radial end opposite the first radial end for supporting the blade 1 and for coupling the blade 1 to a disc (not shown). The blade tip 30 comprises a tip cap 32 disposed over the outer wall 12 of the airfoil 10. The tip cap 32 extends from the leading edge 18 to the trailing edge 20, and further extends laterally between the pressure side 14 and the suction side 16. The tip cap 32 has a radially outer surface 32*b*, which, in the illustrated embodiments, is an essentially flat surface, i.e., at a constant radial height.

In accordance with aspects of the present invention, a trench 40 is defined on a radially outer side of the tip cap 32 facing a hot gas path fluid. The trench 40 is formed by a trench floor 42 flanked on laterally opposite sides by first and second trench side faces 44, 46 (see FIG. 4). The trench side faces 44, 46 extend radially outward from the trench floor 42 to the radially outer surface 32*b* of the tip cap 32. Thereby, the trench floor 42 is located radially inwardly in relation to the radially outer surface 32*b* of the tip cap 32. The trench 40 extends from a trench inlet 52 located at or proximal to the leading edge 18 to a trench outlet 54 located at or proximal to the trailing edge 20. The trench 40 is geometrically configured to entrain a tip leakage flow from the trench inlet 52 to the trench outlet 54 (see FIG. 6). Embodiments of the present invention illustrated herein enable at least the above-mentioned technical effect.

In accordance with various variants of the inventive concept, the trench inlet 52 may be located at the leading edge, or aft of the leading edge 18 on the suction side 16 or on the pressure side 14. The trench outlet 54 may be located at the trailing edge 20, or forward of the trailing edge 20, on the suction side 16 or on the pressure side 14. For example, the trench inlet 52 may located at a position between 0-30% chord-length the airfoil 10, while the trench outlet 54 may be located at a position between 60-100% chord-length of the airfoil 10. In particular, the trench inlet 52 may be located on the pressure side 14 or on the suction side 14, at a position between 5-20% chord-length of the airfoil 10. The trench outlet 54 may be located on the pressure side 14 or on the suction side 14, at a position between 65-95% chord-length of the airfoil 10. In the shown embodiment, both the trench inlet 52 and the trench outlet 54 are located on the suction side 14. In the illustrated embodiment, the trench 40 has a constant lateral width W (i.e., perpendicular distance between the trench side faces 44, 46) as it extends from the trench inlet 52 to the trench outlet 54. The lateral width W of the trench 40 may be equal to or less than 50% of a maximum lateral width $W_A$ of the airfoil 10 (i.e, maximum perpendicular distance between the pressure side 14 and the suction side 16) at the blade tip 30. In other embodiments (not shown), the trench 40 may have a variable lateral width as it extends from the trench inlet 52 to the trench outlet 54, for example, being shaped as a diffuser or a nozzle. In this case, the trench 40 may have a maximum lateral width which is equal to or less than 50% of a maximum lateral width $W_A$ of the airfoil 10 at the blade tip 30. In the present embodiment, as shown in FIG. 3, the trench 40 has both the inlet 52 and the outlet 54 located on the suction side 16, with the trench 40 having maximum proximity to the pressure side 14 (i.e., minimum distance Q) at 40-70% chord-length of the airfoil 10. Referring to FIG. 4, the trench 40 has a radial depth D, defined as the radial distance between the radially outer surface 32*b* of the tip cap 32, and the trench floor 42. The trench 40 may have a constant or variable radial depth D from the trench inlet 52 to the trench outlet 54. In either case, a maximum radial depth of the trench 40 may be configured to lie between one and seven times a radial clearance G between a radially outermost point of the blade tip 30 and a surrounding stationary turbine component 90.

Figure 5:
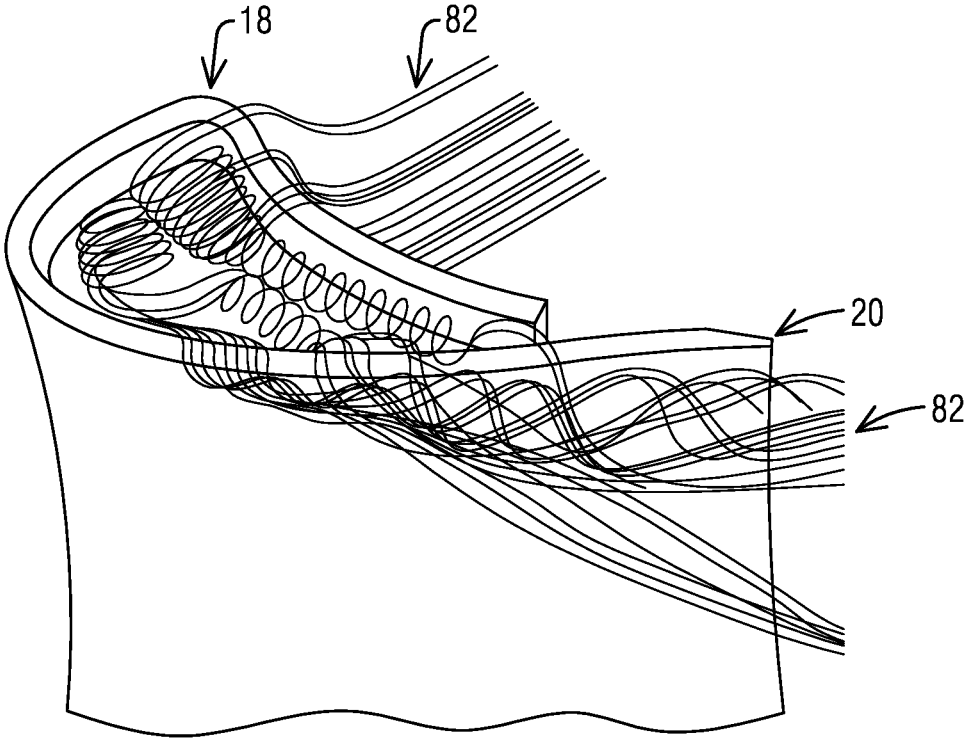
FIG. 5 is perspective view of a turbine blade with a baseline squealer tip configuration, showing streamlines depicting tip leakage flow.
Figure 6:
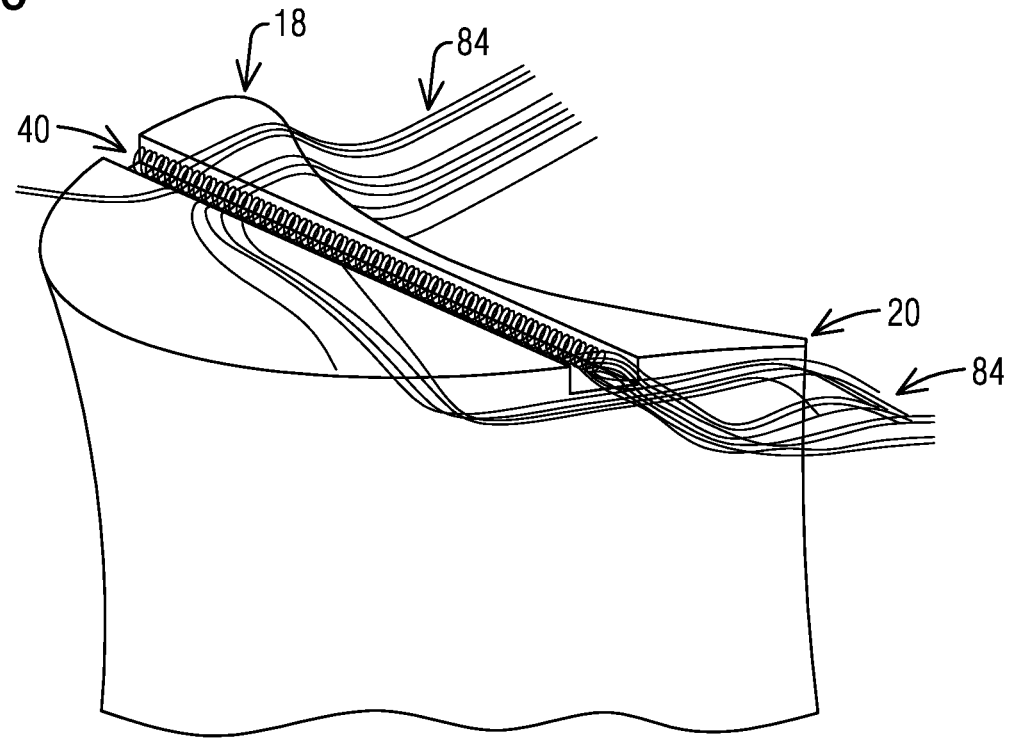
FIG. 6 is perspective view of a turbine blade with a tip trench configuration, showing streamlines depicting tip leakage flow.

The above-described features of the trench 40, acting singly and in combination, may cause a significant reduction of tip leakage from the pressure side to the suction side of the airfoil by entraining the leakage flow in the trench and redirecting it to the trailing edge. The above effect is illustrated referring to FIG. 5-6, where FIG. 5 shows streamlines 82 depicting tip leakage flow over a blade tip with a base-line squealer tip configuration and FIG. 6 shows streamlines 84 depicting tip leakage flow over a blade tip having a tip trench in accordance with aspects of the present invention. As seen from FIG. 6, the cavity created by the trench 40 induces a local vortex that entrains the tip leakage flow 84, blocking most of the tip leakage flow 84 from spilling over to the suction side. In particular, the trench 40 may induce a small and tightly bound vortex structure through the cavity, close to the pressure side of the blade tip. This small and tightly bound vortex entrains the tip leakage flow and redirects it towards the trailing edge 20, thereby reducing further interactions with the bulk passage flow (axial flow). The minimized interaction between the tip leakage flow and the bulk passage flow reduces entropy generation due to mixing, thereby reducing overall losses. By reducing the tip leakage flow across the blade tip, the trench thereby leads to an increase in power.

Figure 7:
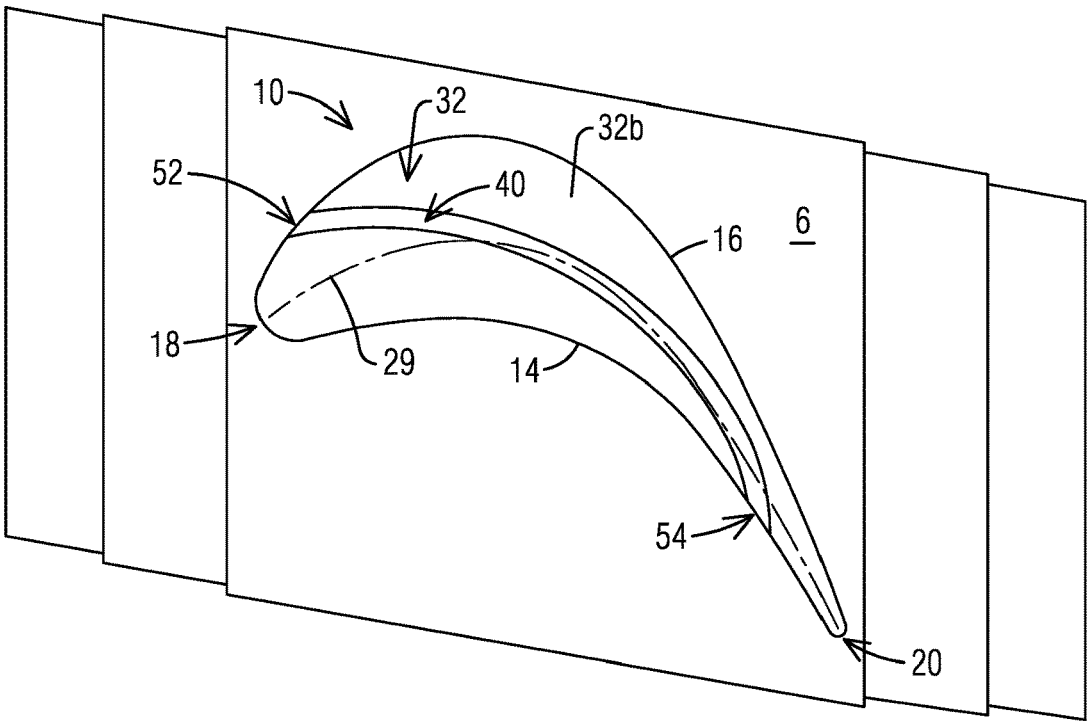
FIG. 7 is a radial top view of a turbine blade with a tip trench in accordance with another embodiment of the invention.

In the embodiment shown in FIG. 3, the trench 40 extends from the trench inlet 52 to the trench outlet 54 along a straight profile. In an alternate embodiment, as shown in FIG. 7, the trench 40 may extend from the trench inlet 52 to the trench outlet 54 along a curved profile. In a further variant (not shown), the profile of the trench 40 may be substantially parallel to the camber line 29 of the airfoil 10.

The above-described tip trench configurations may be used as a replacement of conventional squealer configurations. By entraining a bulk of the tip leakage flow, the tip trench configurations present the possibility to have a higher radial clearance (tip gap) between the blade tip and the stationary ring segment, thereby potentially eliminating the need for a sacrificial feature such as a squealer tip wall. In still further embodiments, the tip trench configuration may be used with other tip-leakage mitigation methods. One such example includes employing a tip trench in conjunction with one or more squealer tip walls extending radially outward from the tip cap. For example, as shown in FIG. 8, the tip trench configuration may be used in conjunction with only a pressure side squealer tip wall 34 extending radially outwardly from the tip cap 32. The pressure side squealer tip wall 34 may extend entirely or partially between the leading edge 18 and the trailing edge 20 and may be positioned flush with the pressure side 14, such that the forward face 34*b* of the pressure side squealer tip wall 34 is contiguous with an outer surface 14*a* of the pressure side 14 of the airfoil. In a different variant, the squealer tip wall 34 may be located between the trench 40 and the pressure side 14 (i.e., not flush with the pressure side 14). In an alternate embodiment, as shown in FIG. 9, the tip trench configuration may be used in conjunction with only a suction side squealer tip wall 36 extending radially outwardly from the tip cap 32. The suction side squealer tip wall 36 may extend entirely or partially between the leading edge 18 and the trailing edge 20 and may be positioned flush with the suction side 16, such that the aft face 36*b* of the suction side squealer tip wall 36 is contiguous with an outer surface 16*a* of the suction side 16 of the airfoil. In a different variant, the squealer tip wall 36 may be located between the trench 40 and the suction side 16 (i.e., not flush with the suction side 16). In a further embodiment, as shown in FIG. 10, the tip trench configuration may be used in conjunction with a pressure side squealer tip wall 34 and a suction side squealer tip wall 36, each extending radially outwardly from the tip cap 32. The pressure side squealer tip wall 34 and the suction side squealer tip wall 36 may each extend entirely or partially between the leading edge 18 and the trailing edge 20, and may each be positioned respectively flush with the pressure side 14 and the suction 16 (as shown in FIG. 10), or positioned between the trench 40 and the pressure side 14 or between the trench and the suction side 16 respectively. Although not shown in FIG. 8-10, in each above described scenarios, one or both of the squealer tip walls 34, 36 may be inclined to the radial direction to further control tip leakage flow.

In further embodiments, still other tip loss mitigation methods may be employed in conjunction with the above illustrated tip trench configurations. An example may include employing a notch on the suction side of the airfoil. A suction side notch of the aforementioned type is disclosed in the European Patent Office Application No. 17186342.6, filed Aug. 16, 2017 by the present Applicant, the content of which is herein incorporated by reference in its entirely. Embodiments may be conceived which combine one or more of the above-discussed tip loss mitigation methods (squealer tip walls, suction side notch, among others) with the presently disclosed tip trench to further control tip leakage flow.

Although not shown, the blade tip may further include cooling holes that discharge coolant from the internal cooling system of the airfoil into the host gas path. The outlets of the cooling holes may be located, for example, on the trench floor, the radially outer surface of the tip cap or on one or more of the squealer tip walls. The generalized blade tip shaping may make efficient use of the coolant flow by controlling the tip leakage flow path. Simultaneous optimization of tip shape and cooling hole location may make use of the change of flow path to cool the blade tip, allowing for reduced coolant flow, improved engine efficiency, and increased component lifetime.

In one embodiment, the blade tip may be formed by an additive manufacturing (AM) method, such as, for example, selective laser melting (SLM). In an example embodiment, the blade tip may be formed by an AM method involving layer by layer material deposition on top of a cast turbine blade. In another embodiment, the blade tip may be manufactured separately as an article of manufacture, for example, by an AM method, and subsequently affixed on top of a cast turbine blade, for example, by brazing. In yet another embodiment, it may be possible to form the entire turbine blade including the blade tip as a monolithic component, for example, by casting or by an AM method. It should be noted that the above-mentioned methods are exemplary, and concepts of the present invention illustrated herein are not limited by the method of manufacture.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine blade comprising:

an airfoil comprising an outer wall formed by a pressure side and a suction side joined at a leading edge and at a trailing edge, a blade tip at a first radial end and a blade root at a second radial end opposite the first radial end for supporting the blade and for coupling the blade to a disc, wherein the blade tip comprises:

a tip cap disposed over the outer wall of the airfoil, wherein a trench is defined on a radially outer side of the tip cap facing a hot gas path fluid, the trench being formed by a trench floor flanked on laterally opposite sides by first and second trench side faces such that the trench floor is located radially inwardly in relation to a radially outer surface of the tip cap, wherein the trench extends from a trench inlet located at or proximal to the leading edge to a trench outlet located at or proximal to the trailing edge, the trench being configured to entrain a tip leakage flow from the trench inlet to the trench outlet, and wherein the trench has a maximum proximity to the pressure side at 40-70% chord-length of the airfoil.

2. The turbine blade according to claim 1, wherein the trench inlet is located at the leading edge or on the pressure side or on the suction side, at a position between 0-30% chord-length of the airfoil, and the trench outlet is located at the trailing edge or on the pressure side or on the suction side, at a position between 60-100% chord-length of the airfoil.

3. The turbine blade according to claim 2, wherein the trench inlet is located on the pressure side or on the suction side, at a position between 5-20% chord-length of the airfoil.

4. The turbine blade according to claim 2, wherein the trench outlet is located on the pressure side or on the suction side, at a position between 65-95% chord-length of the airfoil.

5. The turbine blade according to claim 2, wherein the trench inlet and the trench outlet are both located on the suction side.

6. The turbine blade according to claim 1, wherein the trench has a constant lateral width from the trench inlet to the trench outlet.

7. The turbine blade according to claim 6, wherein the lateral width of the trench is equal to or less than 50% of a maximum lateral width of the airfoil at the blade tip.

8. The turbine blade according to claim 1, wherein the trench has a variable lateral width from the trench inlet to the trench outlet.

9. The turbine blade according to claim 8, wherein a maximum lateral width of the trench is equal to or less than 50% of a maximum lateral width of the airfoil at the blade tip.

10. The turbine blade according to claim 1, wherein the trench has a constant or variable radial depth from the trench inlet to the trench outlet, wherein a maximum radial depth of the trench is between one and seven times a radial clearance between a radially outermost point of the blade tip and a surrounding stationary turbine component.

11. The turbine blade according to claim 1, wherein the trench extends from the trench inlet to the trench outlet along a straight profile.

12. The turbine blade according to claim 1, wherein the trench extends from the trench inlet to the trench outlet along a curved profile.

13. The turbine blade according to claim 1, wherein the radially outer surface of tip cap is at a constant radial height.

14. The turbine blade according to claim 1, further comprising one or more squealer tip walls extending radially outward from the tip cap.

15. A turbine blade comprising:

an airfoil comprising an outer wall formed by a pressure side and a suction side joined at a leading edge and at a trailing edge, a blade tip at a first radial end and a blade root at a second radial end opposite the first radial end for supporting the blade and for coupling the blade to a disc, wherein the blade tip comprises:

a tip cap disposed over the outer wall of the airfoil, wherein a trench is defined on a radially outer side of the tip cap facing a hot gas path fluid, the trench being formed by a trench floor flanked on laterally opposite sides by first and second trench side faces such that the trench floor is located radially inwardly in relation to a radially outer surface of the tip cap, wherein the trench extends from a trench inlet located at or proximal to the leading edge to a trench outlet located at or proximal to the trailing edge, the trench being configured to entrain a tip leakage flow from the trench inlet to the trench outlet, wherein the trench inlet is located at the leading edge or on the pressure side or on the suction side, at a position between 0-30% chord-length of the airfoil, wherein the trench outlet is located at the trailing edge or on the pressure side or on the suction side, at a position between 60-100% chord-length of the airfoil, wherein the trench inlet and the trench outlet are both located on the suction side, and wherein the trench has a maximum proximity to the pressure side at 40-70% chord-length of the airfoil.

* * * * *